US009403581B2

(12) United States Patent
Kalil

(10) Patent No.: US 9,403,581 B2
(45) Date of Patent: Aug. 2, 2016

(54) CUDDY CABIN VESSEL WITH SEPARATE PRIVACY ENCLOSURE

(71) Applicant: Anthony Kalil, Palm City, FL (US)

(72) Inventor: Anthony Kalil, Palm City, FL (US)

( * ) Notice: Subject to any disclaimer, the term of this patent is extended or adjusted under 35 U.S.C. 154(b) by 44 days.

(21) Appl. No.: 13/941,059

(22) Filed: Jul. 12, 2013

(65) Prior Publication Data

US 2015/0013585 A1 Jan. 15, 2015

Related U.S. Application Data

(63) Continuation of application No. 13/097,418, filed on Apr. 29, 2011, now abandoned, which is a continuation of application No. 12/202,904, filed on Sep. 2, 2008, now abandoned.

(60) Provisional application No. 60/969,439, filed on Aug. 31, 2007.

(51) Int. Cl.
*B63B 29/02* (2006.01)
*B63B 29/14* (2006.01)

(52) U.S. Cl.
CPC ..... *B63B 29/14* (2013.01); *B63B 29/02* (2013.01)

(58) Field of Classification Search
CPC ..... B63B 17/02; B63B 29/14
USPC ..... 114/343, 361, 363
See application file for complete search history.

(56) References Cited

U.S. PATENT DOCUMENTS

| | | | | |
|---|---|---|---|---|
| 3,708,009 | A * | 1/1973 | Viol et al. | 160/84.09 |
| 4,092,754 | A * | 6/1978 | Yost | 114/361 |
| 4,566,397 | A * | 1/1986 | Cavanaugh et al. | 114/61.3 |
| 5,029,348 | A * | 7/1991 | Boren | 4/449 |
| 5,673,962 | A * | 10/1997 | Maieli et al. | 296/164 |
| 6,701,863 | B2 * | 3/2004 | Kalhok et al. | 114/361 |
| 7,117,646 | B2 * | 10/2006 | Blaisdell et al. | 52/79.5 |

OTHER PUBLICATIONS

Fortier 26, Boat US, Boat Reviews by Jack Horner N.A., Way Back Machine dated Apr. 2, 2007.*

* cited by examiner

*Primary Examiner* — Stephen Avila
(74) *Attorney, Agent, or Firm* — Saliwanchik, Lloyd & Eisenschenk

(57) ABSTRACT

A privacy enclosure separate from the vessel hold and having at least one entranceway accessible from outside the hold of the vessel.

20 Claims, 5 Drawing Sheets

CUDDY CABIN VESSEL WITH SEPARATE PRIVACY ENCLOSURE

CROSS-REFERENCE TO RELATED APPLICATION

This application is a continuation of U.S. application Ser. No. 13/097,418, filed Apr. 29, 2011, which claims the benefit of U.S. application Ser. No. 12/202,904, filed Sep. 2, 2008, which claims the benefit of U.S. Provisional Application Ser. No. 60/969,439, filed Aug. 31, 2007, which is hereby incorporated by reference herein in its entirety.

BACKGROUND OF INVENTION

There are a variety of small boat vessel designs for various purposes. Cuddy cabin boats are a style of nimble, maneuverable vessel hull design with a closed deck over the bow area. This enclosed deck area, referred to as the "hold" or "cuddy cabin" is often utilized as a living area for sleeping and/or cooking, and often has limited plumbing for a toilet and a sink. Current cuddy cabin designs are usually lacking in privacy, with the personal facilities often in the same area as the sleeping and cooking areas.

There have been some attempts for provide for more private facilities. Some examples of boating vessels with privacy enclosures include U.S. Pat. Nos. 4,092,754; 4,566,397; 5,029,348; and 7,117,646. However, these privacy enclosures are still accessed from within the vessel cabin, or comprise bulky enclosures that sit on a vessel desk, such as a pontoon or deck boat. Relatively few improvements have been made to the interior design of boat holds to provide more privacy. There is a need for vessel hull design that provides a cuddy cabin or hold, as well as a privacy enclosure for personal facilities, such as a toilet or washing area that can be accessed without entering the cabin.

BRIEF SUMMARY

The subject invention provides a vessel design having an incorporated enclosed compartment for use as a marine head or with a portable toilet. The vessel design of the subject invention can be manufactured in accordance with conventional techniques and materials, is of simple construction, and adaptable to a variety of uses other than those that are exemplified herein. The advantages of the vessel design of the subject invention, which will become apparent from the following disclosure, reside in the details of the construction and ability to incorporate the subject invention into currently existing boat designs.

BRIEF DESCRIPTION OF DRAWINGS

In order that a more precise understanding of the above recited invention be obtained, a more particular description of the invention briefly described above will be rendered by reference to specific embodiments thereof that are illustrated in the appended drawings. Understanding that these drawings depict only typical embodiments of the invention and are not therefore to be considered as limiting in scope, the invention will be described and explained with additional specificity and detail through the use of the accompanying drawings in which.

DETAILED DISCLOSURE

Figure 1:
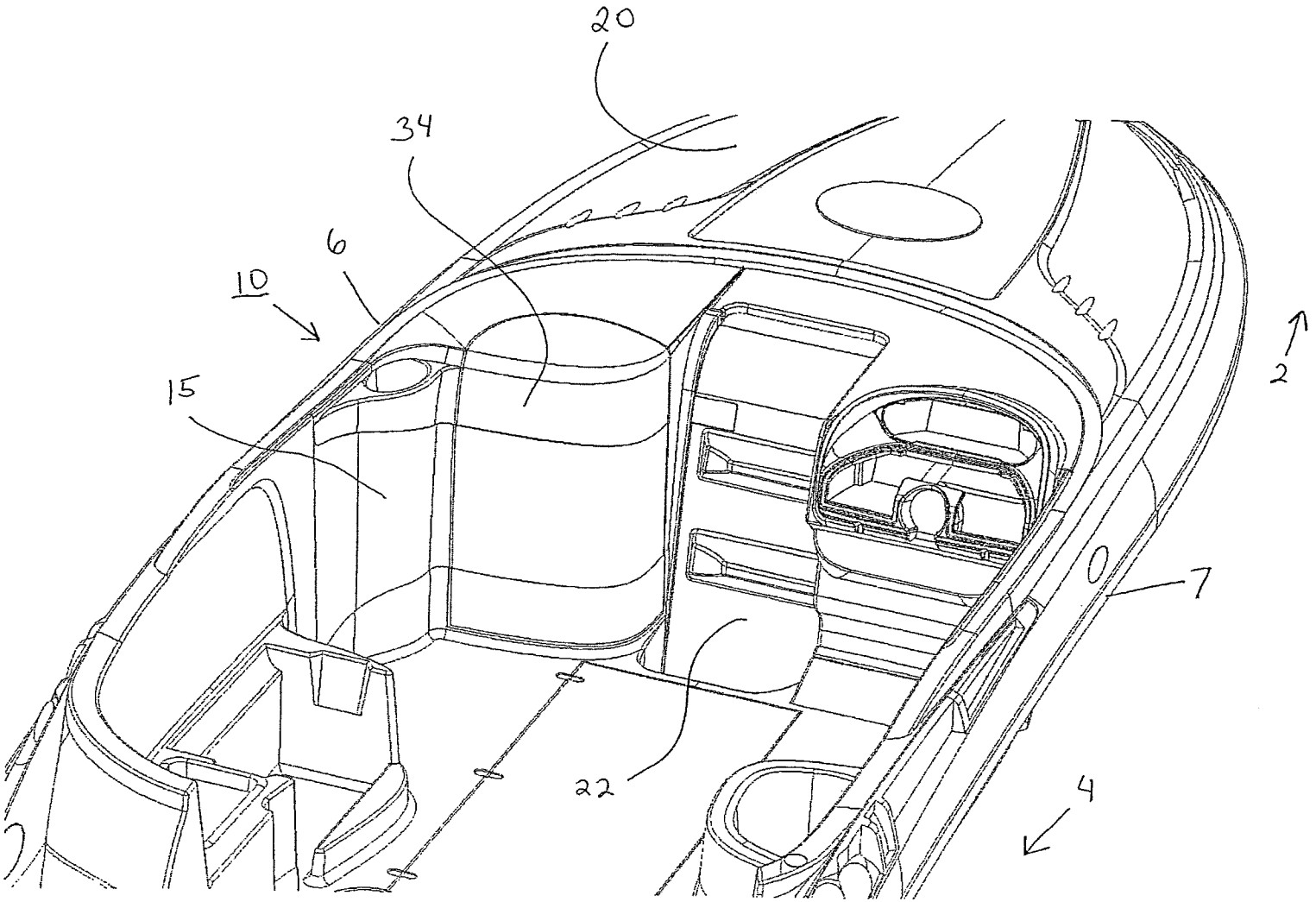
FIG. 1 is an illustration of a perspective view of the cockpit area from the starboard quarter of the boat hull of the subject invention. Shown are the openings to the cuddy cabin and to the privacy enclosure of the subject invention.

The subject invention in general pertains to a privacy enclosure that can be incorporated into a boat or vessel comprising a cuddy cabin or hold and a cockpit. More specifically, the subject invention pertains to a boat or vessel design comprising a cabin or hold, as well as a separate privacy enclosure that are, advantageously, each separately accessible from the cockpit area of a boat. A further advantage of the subject invention is the incorporation of the privacy enclosure into the construction of the boat, which does not detract from the streamline of the boat. The separate entranceway provides privacy and separation of personal facilities from the interior of the cabin compartment.

Thus, the subject invention is particularly useful with vessels comprising a cockpit area and a covered bow hold accessible through an entrance centered and leading from the cockpit. The hold is at least partially below the level of the cockpit, requiring a step down to enter the hold area. Thus, vessels with which the subject invention can be utilized include any of those known in the art with covered holds, including, for example, powerboats, trawlers, yachts, sailboats, cruisers, cuddy cabins, and other vessel types having at least a partially enclosed area.

Therefore, with reference to the attached figures, which show certain embodiments of the subject invention, it can be seen that the subject invention comprises a boat vessel 10 with standard structures known in the art, including a bow 2, stern 4, cockpit area 15, and a covered hold 20. FIGS. 1-4 show one example of a vessel that can utilize the privacy enclosure of the subject invention.

The cockpit area 15 of a vessel of the subject invention can comprise any of a variety of features known in the art of boat manufacturing, including a boat control area, various seating arrangements and storage compartments. Such modification and configurations of the vessel design are considered to be within the scope of the subject invention.

Figure 3:
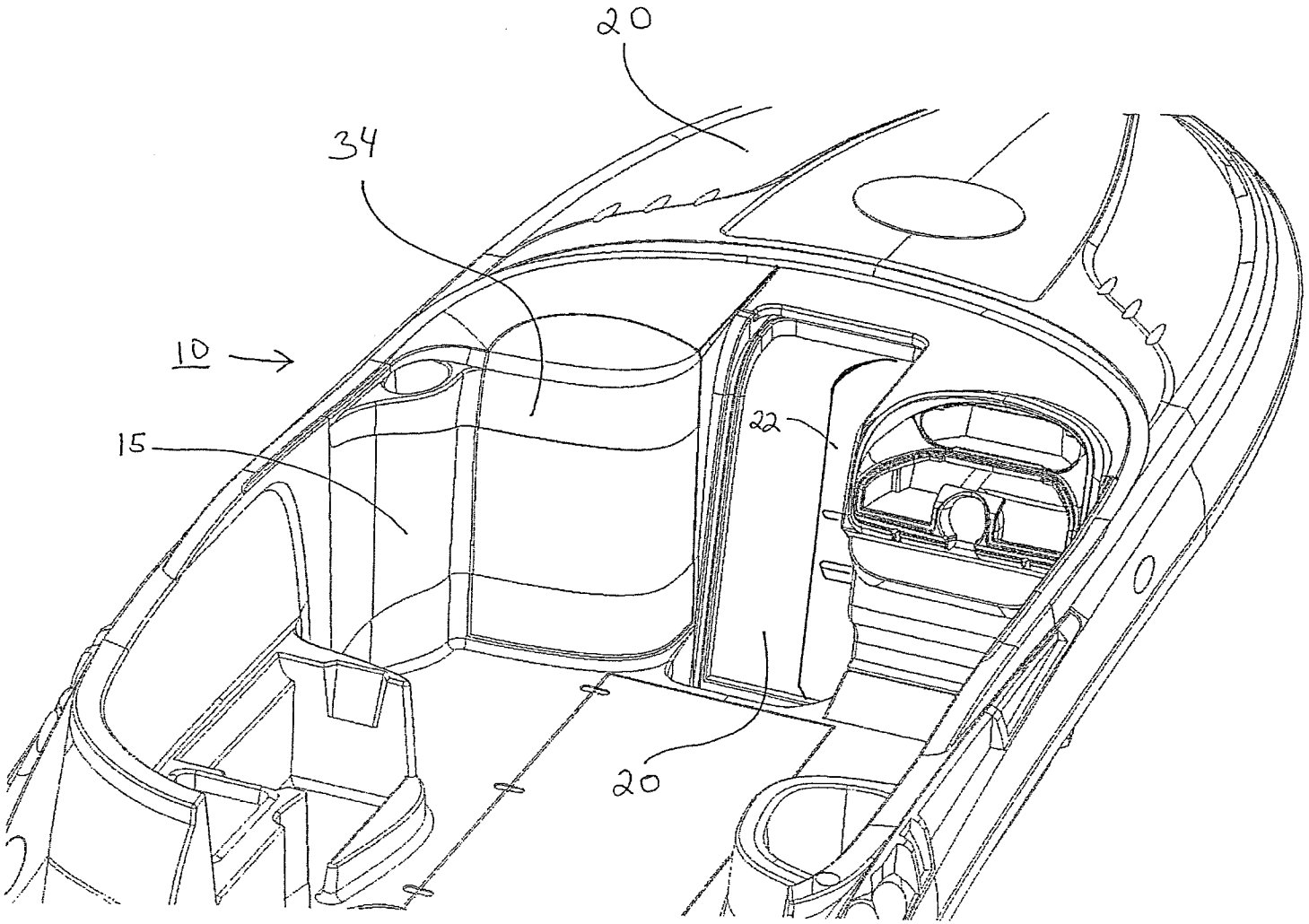
FIG. 3 is an illustration of the cockpit area of FIG. 1 showing the cuddy cabin with an open door. The cuddy cabin door cannot be seen because it swings into the cuddy cabin.

The hold 20 can be separated from the cockpit utilizing any of a variety of hold doors 22 known in the art of vessel design. Hold doors 22 known in the art are configured to open interiorly or exteriorly to the hold 20 of a vessel, depending upon the style of entranceway. Often, hold doors open to the interior of the hold to reduce or prevent contact or interference of the door with people and/or objects in the cockpit area 15, as shown for example in FIG. 3. Further, because the hold of a boat is often below the deck level of the cockpit, it is necessary to step down into a hold. Thus, the hold door is often also positioned at least partially below deck level and opens interiorly to the hold to more easily accommodate entrance to the hold. FIG. 3 shows an example of a hold located below the deck level of a vessel cockpit area and having an interiorly directed door.

Figure 2:
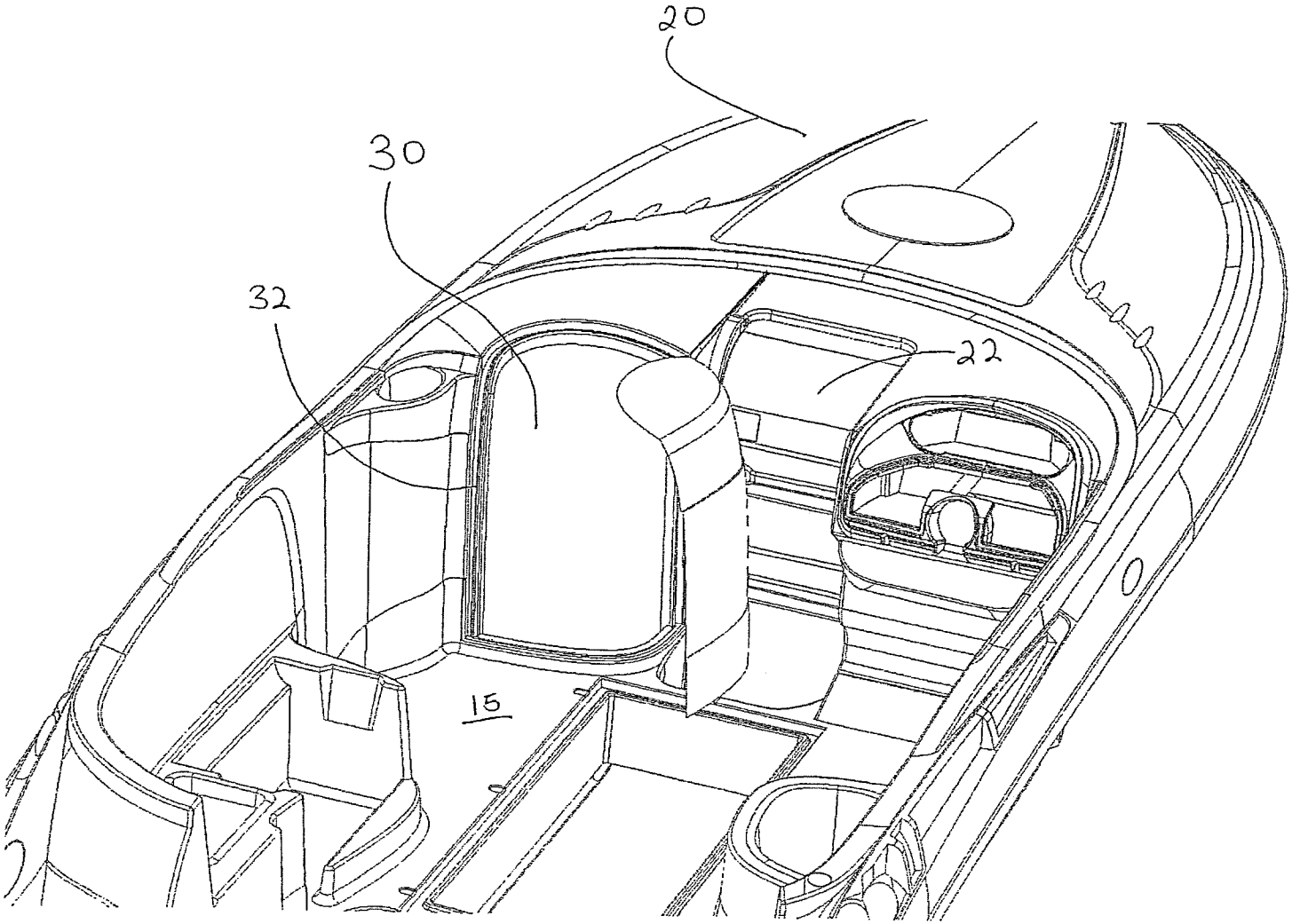
FIG. 2 is an illustration of the cockpit area of FIG. 1 showing the privacy enclosure with an open door.

As mentioned above, a unique feature of the vessel design of the subject invention is a privacy enclosure 30 having at least one entranceway 32 located outside the vessel's hold 20, an example of which is shown in FIGS. 1 and 2. In an embodiment, the at least one entranceway 32 is accessible from the cockpit area 15 of a vessel 10. But, in alternative embodiments, at least one entranceway 32 can be accessible from other areas of the vessel, including, for example, a walkway, a console door, hatchway, or other area of the vessel. And, in a further alternative embodiment, not shown in the Figures, the privacy enclosure 30 can have both an entranceway 32 from the cockpit area 15 and from the hold 20.

In one embodiment, the entranceway 32 is positioned at the port 6, or left, side of the hold door 22, as shown, for example in FIG. 2. Alternatively, the entranceway can be located on the starboard 7, or right, side of the hold door. A person with skill in the art will be able to determine an arrangement of the cockpit area 15, including the location of the boat controls, seating, storage, etc. that can accommodate alternative locations of the privacy enclosure 30 and its entranceway 32.

Vessels that have holds, most often, also have personal facilities therein. These facilities are often located at either the bow 2 or stern 4 of the hold 20. Thus, in these vessel designs, at least one wall of the personal facility area is in contact with the outside area of the vessel. Therefore, in a further embodiment, at least one entranceway 32 is positioned within an outside wall in contact with the personal facilities within the hold of a vessel.

In an alternative embodiment, utilizing techniques and materials known in the art, a portion of the hold 20 near an outside facing wall can be isolated from the interior of the hold to provide space for a privacy enclosure 30. An entranceway 32 can then be incorporated into the outside wall of the hold to provide access to the privacy enclosure from outside the hold 20. Alternatively, as mentioned above, a further entranceway 32 can be provided from within the hold 20, so that the privacy enclosure has at least two entranceways.

In a preferred embodiment, the privacy enclosure 30 of the subject invention comprises an entranceway 32 from the cockpit 15 of a vessel having a bow hold 20, as shown for example in FIGS. 1-4. Usually, as mentioned above, in such vessel designs the level of the hold is below the level of the cockpit, as seen in the FIG. 3. Thus, in one embodiment, the level of the privacy enclosure 30 of the subject invention can also be at or near the same level as the hold 20. This can maximize the space in the privacy enclosure 30, providing more headroom for example. But, in an alternative embodiment, the privacy enclosure can be at the same level as the cockpit deck.

In a further embodiment, the privacy enclosure 30 comprises at least one door 34 to seclude the enclosure and any occupant(s) therein. As mentioned above, alternative embodiments of the privacy enclosure 30 of the subject invention can have more than one entranceway. Therefore, preferably, each entranceway 32 provided to the privacy enclosure 30 will have a door affixed thereto.

One embodiment of the privacy enclosure comprises an entranceway and enclosure door 34 positioned similarly to that of a hold opening and hold door 22 that is hung at least partially below the cockpit deck level, as described above. In this embodiment, the level of the privacy enclosure will be near or equivalent to the level of the hold.

In an alternative embodiment, the level of the enclosure door 34 can be at or near the deck level of the cockpit, as shown for example in FIGS. 1 and 2. In this embodiment, the level of the privacy enclosure 30 can be near or at the level of the hold. And, in a further embodiment, the enclosure door 34 can be affixed to open exteriorly, over the deck of the cockpit, as shown, for example in FIG. 2. In this embodiment, the level of the privacy enclosure is below deck level of the cockpit, requiring a step down to enter the enclosure 30, the enclosure door 34 following afterwards to close.

Figure 4:
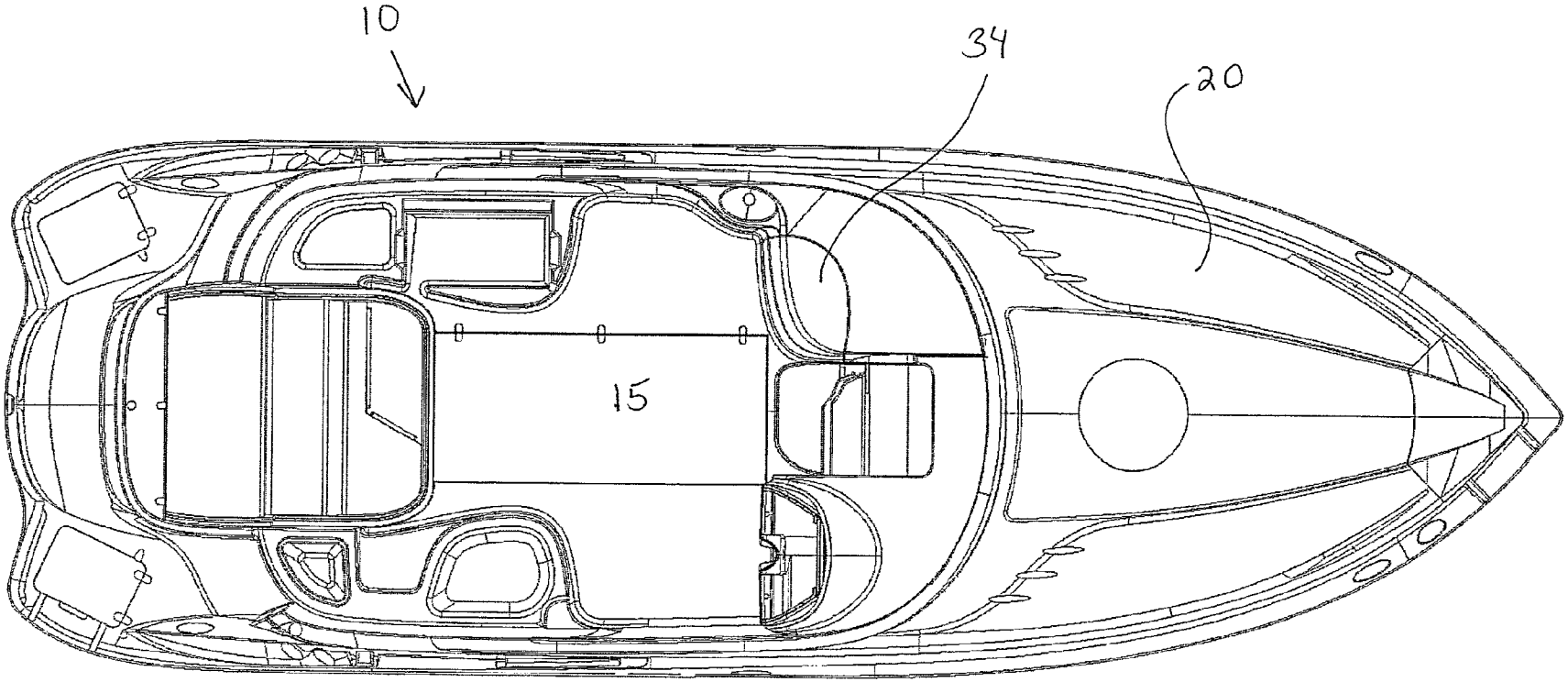
FIG. 4 is a top plan view of the boat hull of the subject invention.

The enclosure door can comprise any of a variety of door styles known in the art, including those that are collapsible, foldable, flexible, molded, or similar devices. In one embodiment, the enclosure door 34 can be a contoured rigid or semi-rigid panel, as shown in FIGS. 2 and 4 to accommodate the shape of the hold wall or console area into which the door closes. Thus, in one embodiment, the door is contoured to close flush with the console of the cockpit area 15, as shown, for example in FIG. 4. In a further embodiment, the door is positioned over the entranceway utilizing any of a variety of techniques and devices known to those with skill in the art. In one embodiment, the door is positioned with one or more swinging hinges that allow the door 34 to swing open either inwards to outwards.

Figure 5:
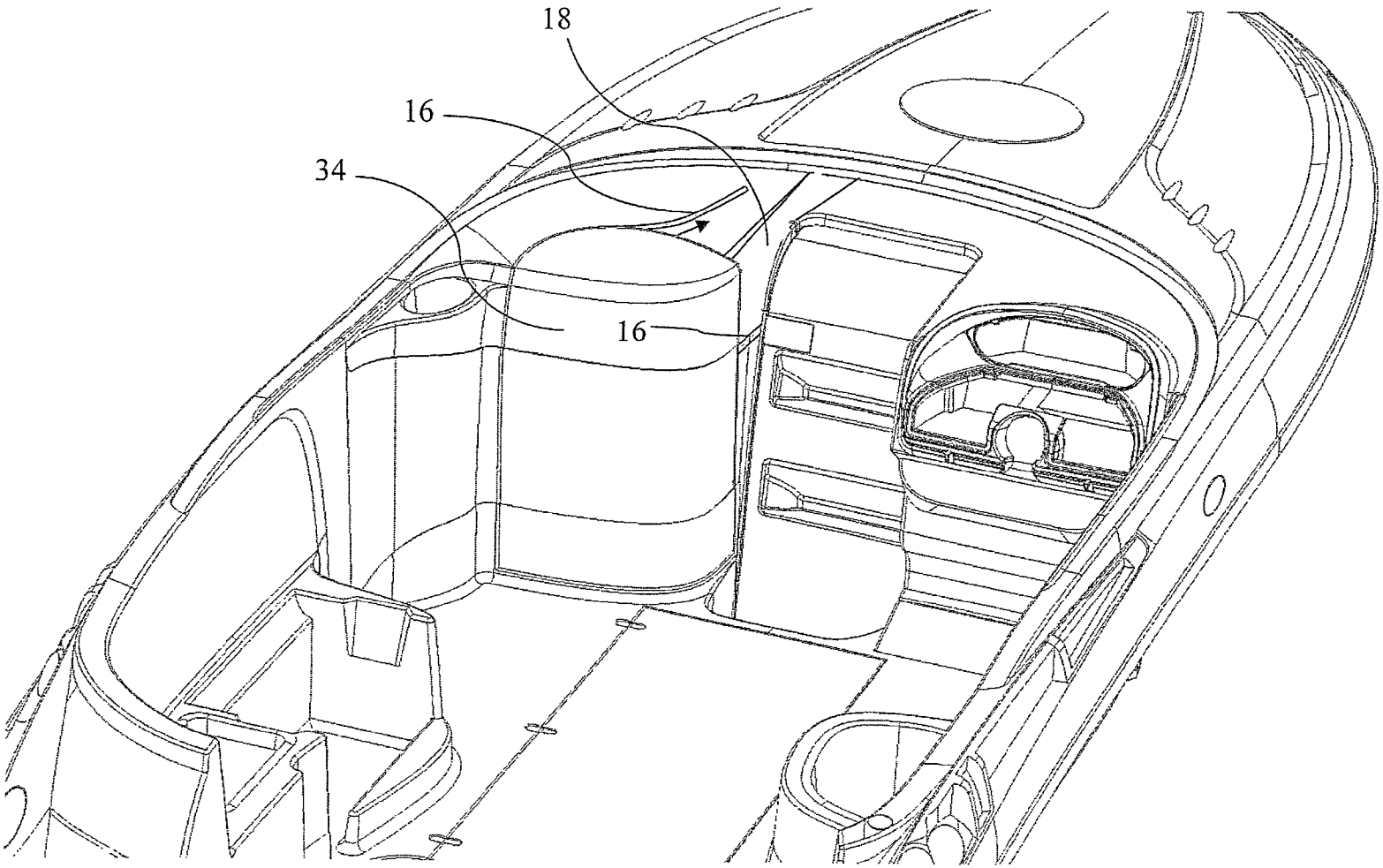
FIG. 5 is an illustration of a perspective view of the cockpit area from the starboard quarter of the boat hull of the subject invention. Shown are the openings to the cuddy cabin and to the privacy enclosure of the subject invention.

In an alternative embodiment, the enclosure door 34 can be mounted on one or more sliding tracks 16 that conform to the contours of an outside wall 18 of the enclosure, for example, as shown in FIG. 5. In this embodiment, the enclosure door can be slid open and closed by pushing, pulling or otherwise slidably moving the enclosure door 34 along the one or more tracks or sets of tracks. The tracks 16 can be mounted in one or more locations. In one embodiment, shown in FIG. 5, the tracks are located in such a position that the top of the enclosure door is slidably attached to tracks 16, so that the enclosure door, in general, hangs from the tracks. In an alternative embodiment, the tracks are located at or near the bottom of the enclosure door, such that the bottom end of the door is slidably attached to the tracks. In a still further embodiment, for example, as also seen in FIG. 5, the enclosure door is slidably attached to the tracks at or near the middle of the door, or at some other point between the top and bottom of the enclosure.

In a further embodiment, the contours of the enclosure door conform to, or are otherwise compatible with, the contours of an adjacent enclosure wall 18 or other structure against which the enclosure door will be moved. For example, the enclosure door can be generally vertically planar (or flat), and slide along tracks located along the top end and/or bottom end of the enclosure door. As the enclosure door slides along the tracks it moves parallel with and along one or the other side of an adjacent enclosure wall 18. In a further embodiment, the door slides generally flush with the adjacent enclosure wall 18.

In an alternative embodiment, the enclosure door can comprise a flexible, or semi-rigid material that can change contour or shape, as it moves along one or more tracks. This allows the enclosure door to conform to the shape of the entranceway 32, as well as the shape of an adjacent enclosure wall 18, as the door is slid open.

In yet other embodiments the door can be slid from a closed position near the center of the deck towards the external wall of the hull to open. In such an open configuration the door 34 will be in close proximity to the interior wall of the vessel hull. Many variations on these embodiments are possible. The selection of an appropriate sliding door and track configuration is within the competence of those skilled in the art, as are its dimensions for the intended purpose.

The invention has been described herein in considerable detail, in order to comply with the Patent Statutes and to provide those skilled in the art with information needed to apply the novel principles, and to construct and use such specialized components as are required. However, it is to be understood that the invention can be carried out by specifically different equipment and devices, and that various modification, both as to equipment details and operating procedures can be effected without departing from the scope of the invention itself. Further, it should be understood that, although the present invention has been described with reference to specific details of certain embodiments thereof, it is not intended that such details should be regarded as limitations upon the scope of the invention except as and to the extent that they are included in the accompanying claims.

What is claimed is:

1. A vessel hull comprising:

a cockpit area having a deck;

a covered hold area accessible through a hold doorway;

a privacy enclosure having at least one entranceway located outside the covered hold area;

a toilet located within the privacy enclosure; and an enclosure door covering the entranceway, said enclosure door being accessible from the cockpit without passing through the hold doorway or through the hold cover, said enclosure door providing access to the privacy enclosure from the cockpit through a bulkhead.

2. The vessel hull according to claim 1, wherein the enclosure door is deformable such that it can be deformed in shape to facilitate entry or exit.

3. The vessel hull according to claim 1, further comprising one or more sliding tracks in which the enclosure door is slidably mounted to facilitate entry or exit.

4. The vessel hull according to claim 1, wherein the enclosure door is affixed with one or more swinging hinges.

5. The vessel hull according to claim 1, wherein a floor of the privacy enclosure is at the same level as the deck.

6. The vessel hull according to claim 1, wherein a floor of the privacy enclosure is below the deck level.

7. The vessel hull according to claim 1, further comprising a second entranceway into said privacy enclosure, said second entranceway being located in the hold area.

8. The vessel hull according to claim 1, wherein a bottom edge of the enclosure door is no lower than a floor of the cockpit.

9. The vessel hull, according to claim 1, wherein a bottom edge of the enclosure door is below a floor level of the cockpit.

10. The vessel hull according to claim 3, wherein the enclosure door comprises a rigid or semi-rigid material contoured to maintain its shape as it is opened.

11. The vessel hull according to claim 3, wherein the enclosure door comprises a deformable portion that can be deformed in shape to facilitate entry or exit.

12. The vessel hull according to claim 3, wherein a floor of a privacy enclosure is at the same level as the deck.

13. The vessel hull according to claim 3, wherein a floor of the privacy enclosure is below the deck level.

14. The vessel hull according to claim 13, wherein the privacy enclosure extends fore of the bulkhead and into the covered hold area.

15. The vessel hull according to claim 14, further comprising a second entranceway into said privacy enclosure, said second entranceway being located in the covered hold area.

16. The vessel hull according to claim 3, wherein a bottom edge of the enclosure door is no lower than a floor of the cockpit.

17. The vessel hull, according to claim 3, wherein a bottom edge of the enclosure door is below a floor level of the cockpit.

18. In a vessel hull having a cockpit area, a bulkhead defining an aft-most portion of a covered hold area, and a hold access door to the covered hold area; the improvement comprising a privacy enclosure and a privacy enclosure access door to the privacy enclosure, said privacy enclosure access door being accessible from the cockpit without passing through the hold access door or through the hold cover, said privacy enclosure access door providing access for a person to enter said privacy enclosure through the bulkhead, wherein a volume of said privacy enclosure extends fore of said bulkhead.

19. A vessel hull comprising:

a cockpit area having a deck;

a covered hold area accessible through a hold doorway or through a centrally located entranceway leading from the cockpit;

a privacy enclosure having at least one entranceway located outside the covered hold area;

a toilet located within the privacy enclosure;

and an enclosure door covering the privacy enclosure entranceway, said enclosure door being accessible from the cockpit without passing through the hold doorway, without passing through or removing the hold cover, and without entering the central entranceway;

wherein said enclosure door provides access to said privacy enclosure from the cockpit area through a bulkhead.

20. The vessel hull according to claim 19, wherein the hold area is at least partially below deck level of the cockpit.

* * * * *